US011261611B2

(12) United States Patent
Abramov

(10) Patent No.: US 11,261,611 B2
(45) Date of Patent: Mar. 1, 2022

(54) ARTIFICIAL WAVE GENERATION SURFING FACILITY

(71) Applicant: WaveBox Ltd., Nicosia (CY)

(72) Inventor: Aleksandr Gennad'evich Abramov, Moscow (RU)

(73) Assignee: Wave Box Ltd, Nicosia (CY)

( * ) Notice: Subject to any disclaimer, the term of this patent is extended or adjusted under 35 U.S.C. 154(b) by 0 days.

(21) Appl. No.: 16/889,907

(22) Filed: Jun. 2, 2020

(65) Prior Publication Data

US 2021/0372152 A1 Dec. 2, 2021

(51) Int. Cl.
*E04H 4/00* (2006.01)
*A63G 31/00* (2006.01)
*A63B 69/00* (2006.01)

(52) U.S. Cl.
CPC ..... *E04H 4/0006* (2013.01); *A63G 31/007* (2013.01); *A63B 69/0093* (2013.01)

(58) Field of Classification Search
CPC .. E04H 4/0006; A63B 69/0093; A63G 31/007
See application file for complete search history.

(56) References Cited

U.S. PATENT DOCUMENTS 5,913,636 A * 6/1999 Macaulay ..... E02B 3/06 405/79
7,326,001 B2 * 2/2008 McFarland ..... A63G 3/00 405/79
8,516,624 B2 8/2013 Klimaschewski
2003/0180095 A1 * 9/2003 McFarland ..... E04B 9/06 405/79
2009/0169305 A1 * 7/2009 Lochtefeld ..... A63G 31/007 405/79
2009/0185863 A1 * 7/2009 McFarland ..... A63G 31/007 405/79
2010/0135727 A1 * 6/2010 McFarland ..... A63G 31/007 405/79
2012/0020735 A1 * 1/2012 Fricano ..... E04H 4/0006 405/79
2018/0209159 A1 * 7/2018 Perslow ..... E04H 4/0006

* cited by examiner

*Primary Examiner* — Carib A Oquendo
(74) *Attorney, Agent, or Firm* — DeFillo & Associates, Inc.; Evelyn A DeFillo

(57) ABSTRACT

The invention relates to water amusement facilities generating artificial waves for surfing. The technical result is a simpler and lighter design and a shorter assembly and dismantling time along with the capability to control the water flow rate and to stabilize the flow. The above technical result is achieved by the proposed artificial wave generation surfing facility, including a water tank having installed at its upper portion: a working surface having an inclined section and a drainage grille; a submersible pump whose outlet is connected to a water moving device (hydraulic unit), with the hydraulic unit's outlet being positioned above the working surface, the working surface is laid over flooring with a wave generation threshold and the hydraulic unit's outlet is partitioned into sections, the hydraulic unit's outlet has a direct exit channel to the upper edge of the working surface inclined section, while the lower edge of the working surface inclined section makes a smooth transition to the wave generation threshold.

3 Claims, 8 Drawing Sheets

ARTIFICIAL WAVE GENERATION SURFING FACILITY

FIELD OF THE INVENTION

The invention relates to water amusement facilities producing artificial waves for surfing.

BACKGROUND OF THE INVENTION

One known design of an artificial wave generation surfing facility is described in U.S. Pat. No. 8,516,624 (published on 2013 Aug. 27). This prior art design has been chosen as the closest analog.

The closest analogous artificial wave generation surfing facility comprises: a main pool; a wave pool; an inclined ramp whose bottom end extends down into the pool, a horizontally arranged flow section flow section connected at an outlet end thereof to an upper end of the ramp; at least one pump connected to an inlet end of the flow section by means of which water is conveyed from the main pool to the flow section; at least one adjustable guide device in the wave pool at a distance downstream from the lower end of the ramp, wherein the wave pool is positioned above the main pool, wherein the at least one pump unit, during operation, being adapted to produce a liquid level in the wave pool sufficient to produce a defined resistance to water flowing down the ramp which will enable formation of the standing wave at the at least one adjustable guide device by a change of the flow velocity of the water, and an overflow via which water is able to flow back from the wave pool into the main pool, the overflow being provided with an adjusting mechanism that enables the water level in the wave pool to be regulated in a manner enabling, in a resting state, retaining of a total amount of water to fill the main pool and wave pool to a level sufficient to provide said defined resistance upon commencement of operation.

One disadvantage of the prior art is the inclusion of the horizontally arranged section to which water is pumped. Adjoining to the side of the horizontally arranged flow section is the edge of the inclined surface abutting on the pool bottom with the other end. It is noted that the length of the inclined section would be preferably half the length of the horizontal flow section.

Therefore, the entire structure of the surfing facility requires supplemental support structural members (pillars and beams) that should hold in place the horizontal flow section. It makes the structure more complex, heavyweight and cumbersome, extending the assembly and dismantling time.

Also, the side walls of the surfing facility will be moved together to stabilize and regulate the water flow, which gives rise to further technical difficulties and the need to use additional drives and actuators.

SUMMARY OF THE INVENTION

It is, therefore, an objective of the proposed invention to address the above issues.

The technical result of the invention is a simpler and lighter design and a shorter assembly and dismantling time along with the capability to control the water flow rate and to stabilize the flow.

The above technical result is achieved by providing an artificial wave generation surfing facility, comprising a water tank having installed at its upper portion: a working surface having an inclined section and a drainage grille; further comprising a submersible pump whose outlet is connected to a water moving (lifting) machine (hydraulic unit), with the hydraulic unit's outlet being positioned above the working surface, wherein the working surface is laid over flooring with a wave generation threshold, and the hydraulic unit's outlet is partitioned into sections, characterized in that the hydraulic unit's outlet has a direct exit channel to the upper edge of the working surface inclined section, while the lower edge of the working surface inclined section makes a smooth transition to the wave generation threshold.

The working surface inclined section may be provided with a partition with sections used to stabilize the flow.

The inclined section may be configured tapering from upper to lower edge.

The inclined section may be configured tapering from upper to lower edge to a specified level from which the flow width to the inclined section lower edge coming into abutment with the bottom remains constant.

The span where the flow width remains constant may house the partition with sections used to stabilize the flow.

The wave generation threshold may be configured as a fixture repositionable relative to the flooring.

DETAILED DESCRIPTION OF THE INVENTION

Figure 1:
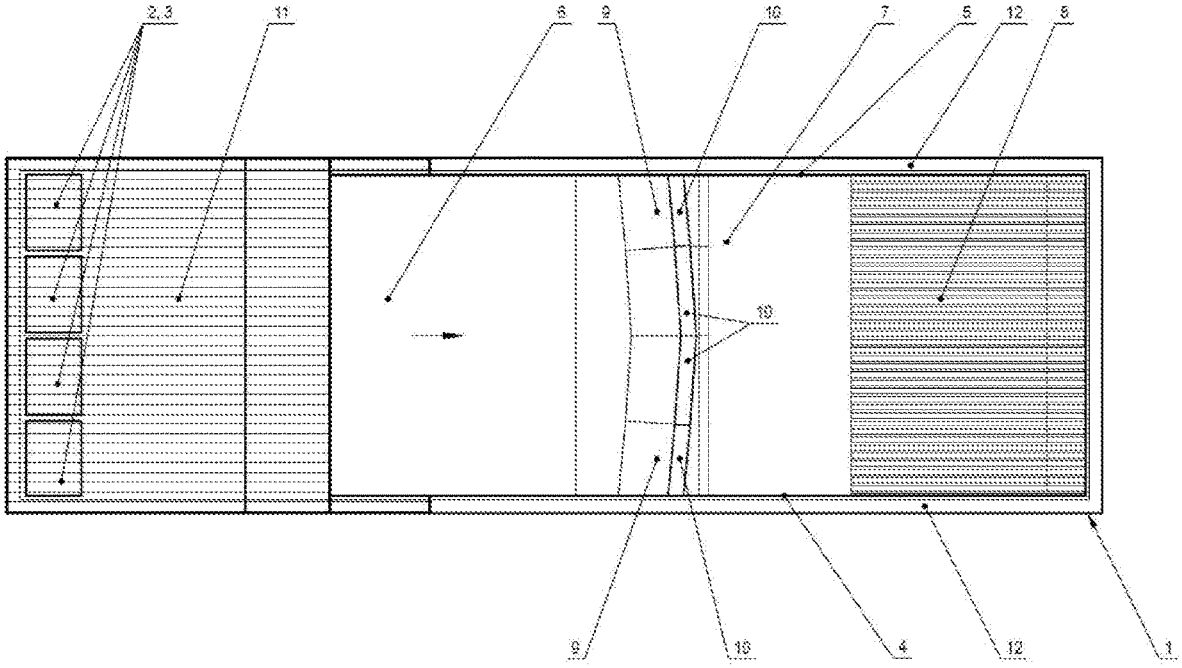
FIG. 1 shows a top view of the surfing facility according to an embodiment of the present invention showing the surfing facility in the operating state.

In the drawings: 1—reinforced concrete bowl (water tank), 2—water moving (lifting) machine (hydraulic unit with water injection nozzles), 3—submersible pump, 4—left-hand side of channel, 5—right-hand side of channel, 6—wave fetching portion of channel, 7—channel bottom, 8—drainage grille, 9—threshold, 10—lifting (wave forming) crest , 11—two tier central platform, 12—side initiating platform, 13—water level, 14—riding wave, 15—crest hoist, 16—partition with sections (flow stabilizer), 17—control plate on drainage grilles.

Figure 2:
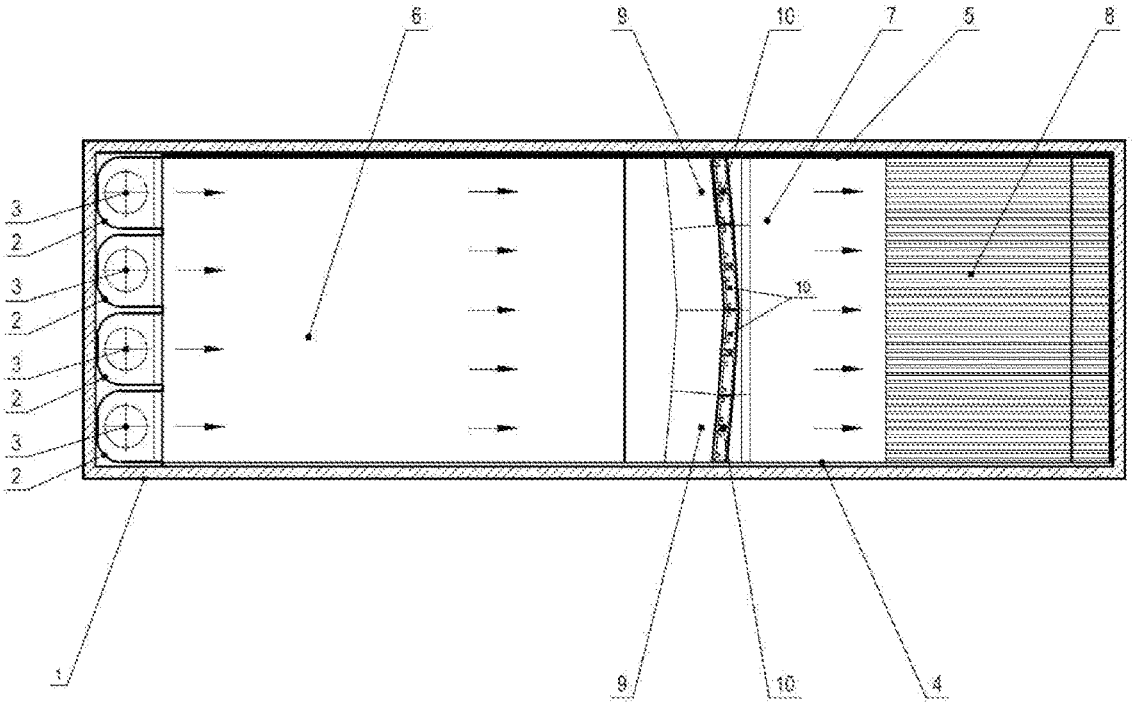
FIG. 2 shows the top view of the surface facility of FIG. 1 without inspection platforms.
Figure 3A:
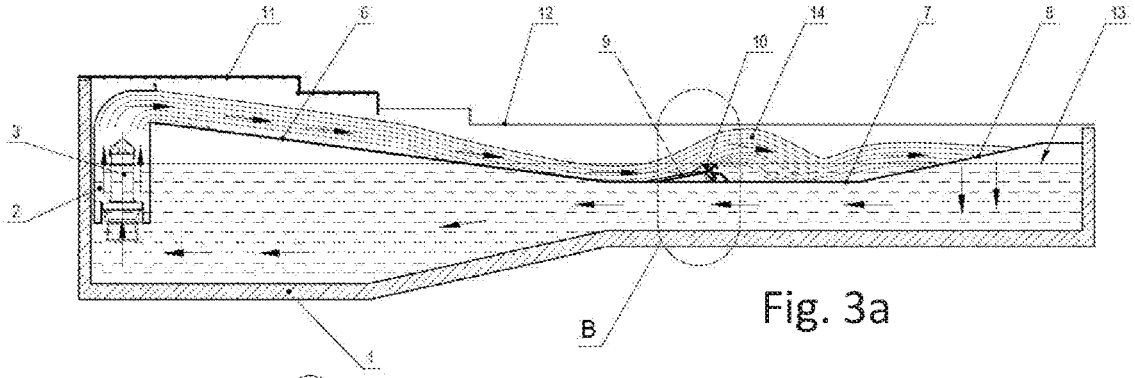
FIG. 3*a* shows a cross sectional view of the wave crest section of the surface facility of FIG. 1.
Figure 3B:
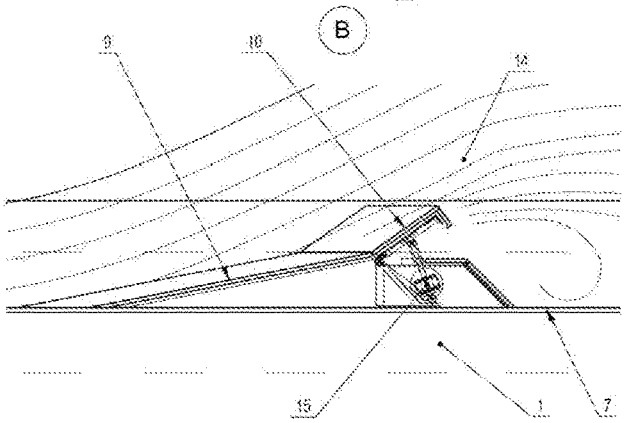
FIG. 3*b* shows an enlarged view of the wave crest section around section B of FIG. 3*a;*

The artificial wave generation surfing facility includes a water tank 1 (ref. to FIG. 1, FIG. 2, and FIG. 3) having installed at its upper portion a working surface having inclined section 6, drainage grille 8 that may have control plates 17.

The facility further comprises a submersible pump 3 whose outlet is connected to a water moving (lifting) machine (hydraulic unit) 2 with the hydraulic unit outlet being positioned above the working surface.

The working surface is laid over the flooring having threshold 9 used for generating a wave 14.

Furthermore, the water moving (lifting) machine (hydraulic unit) 2 outlet is split into sections.

The novelty is that the water moving (lifting) machine (hydraulic unit) 2 outlet has the direct exit channel to the upper edge of the working surface inclined section 6 and the lower edge of the working surface inclined section 6 smoothly transitions into wave generation threshold 9.

A simpler design, a smaller weight, and a shorter assembly and dismantling time is ensured by obviating the need for additional support structures (pillars and beams) that should hold in place the horizontal flow section. This horizontal flow section is made redundant in the claimed facility by connecting inclined section 6 directly to threshold 9 and hydraulic unit 2 outlet.

Alternative embodiments of the facility include the following additions to the facility design.

Figure 4A:
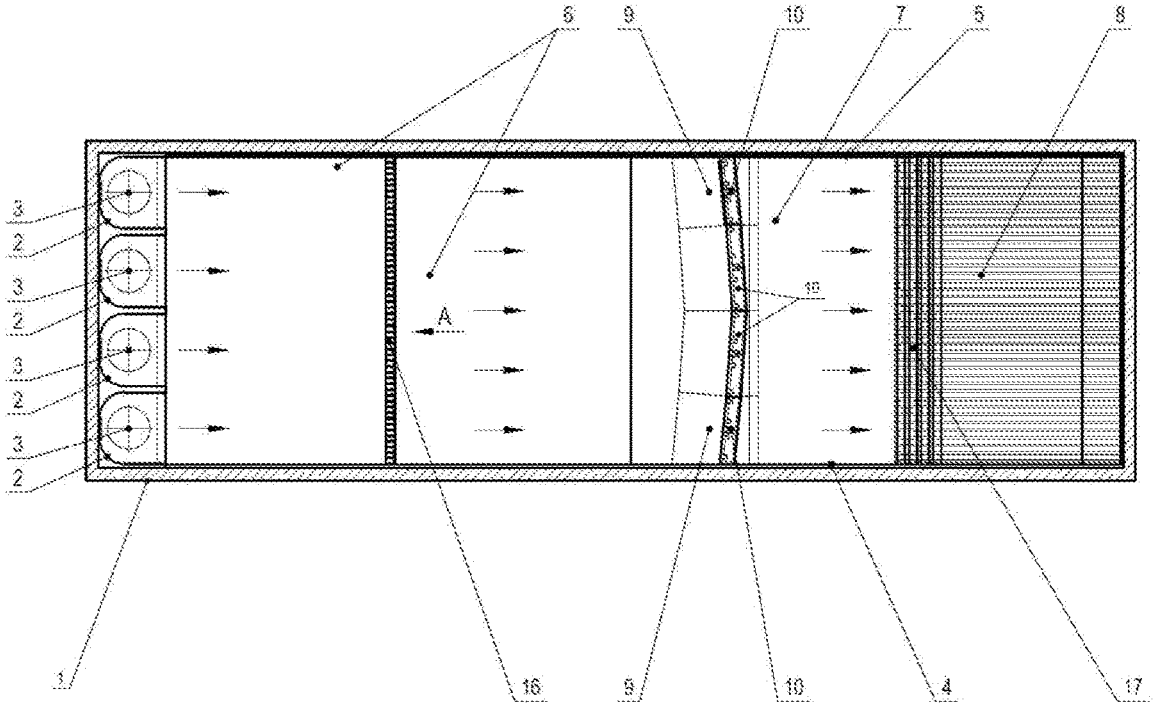
FIG. 4*a* shows a top view of the surface facility of FIG. 1 without inspection platforms.
Figure 4B:
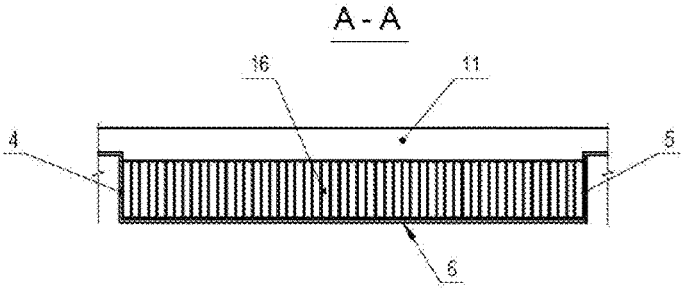
FIG. 4*b* shows a side view of a flow stabilizer of FIG. 4*a;*
Figure 5A:
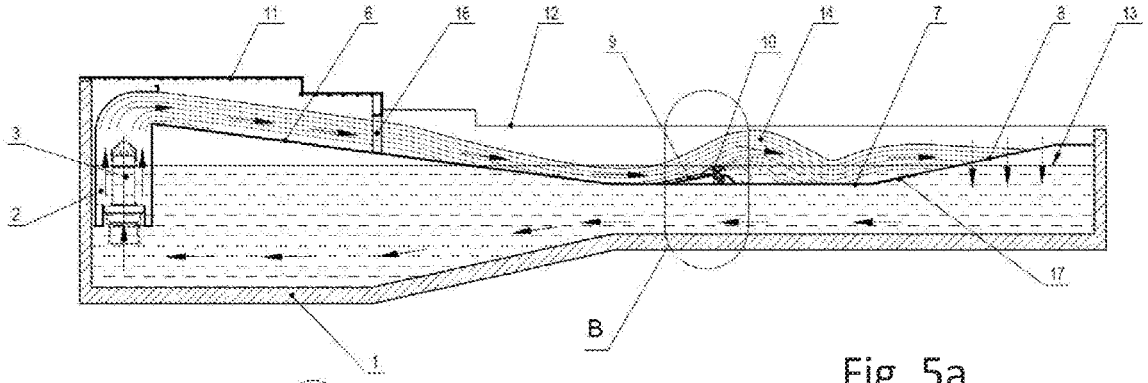
FIG. 5*a* shows a cross sectional view of the surface facility of FIG. 1 including a flow stabilizer and the wave crest section.
Figure 5B:
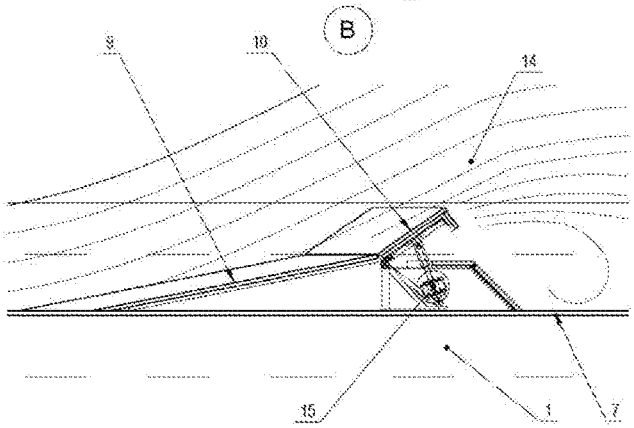
FIG. 5*b* shows an enlarged view of the wave crest section around section B of FIG. 5*a;*

Working surface inclined section 6 may house partition 16 split into sections used to stabilize the flow (see the embodiments in FIG. 4 and FIG. 5). By shutting off sections in partition 16, for instance, by means of gate valves, water flow may be stabilized and water flow rate may be controlled without the need for side walls of the surfing facility to be moved together, thus making the design simpler while retaining the capability to control the water flow rate and to stabilize the flow.

Inclined section 6 may be configured tapering from upper to lower edge thus creating a downward slope of the channel left-hand side 4 and/or the right-hand side 5, which makes the design simpler while retaining the capability to control the water flow rate and to stabilize the flow.

Figure 6:
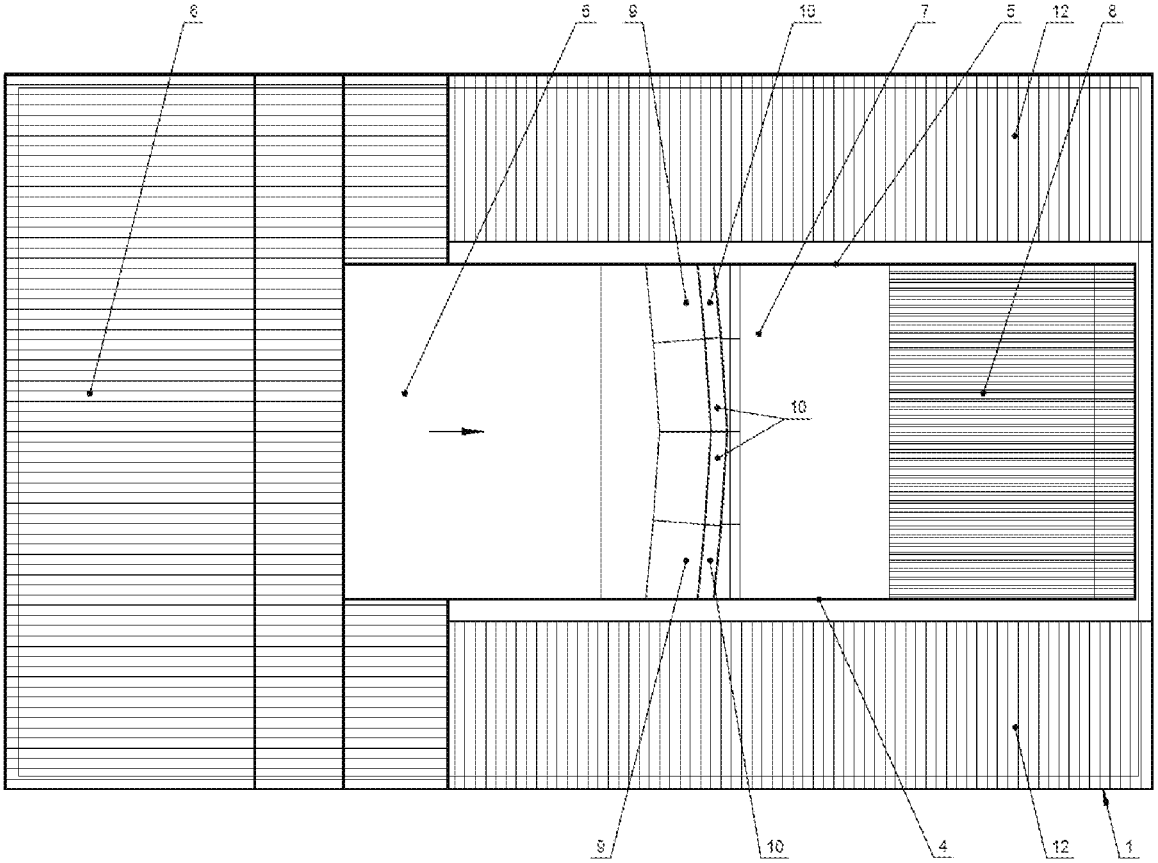
FIG. 6 shows a top view of the surfing facility according to the present invention showing a tapering inclined surface in the operating state.
Figure 7:
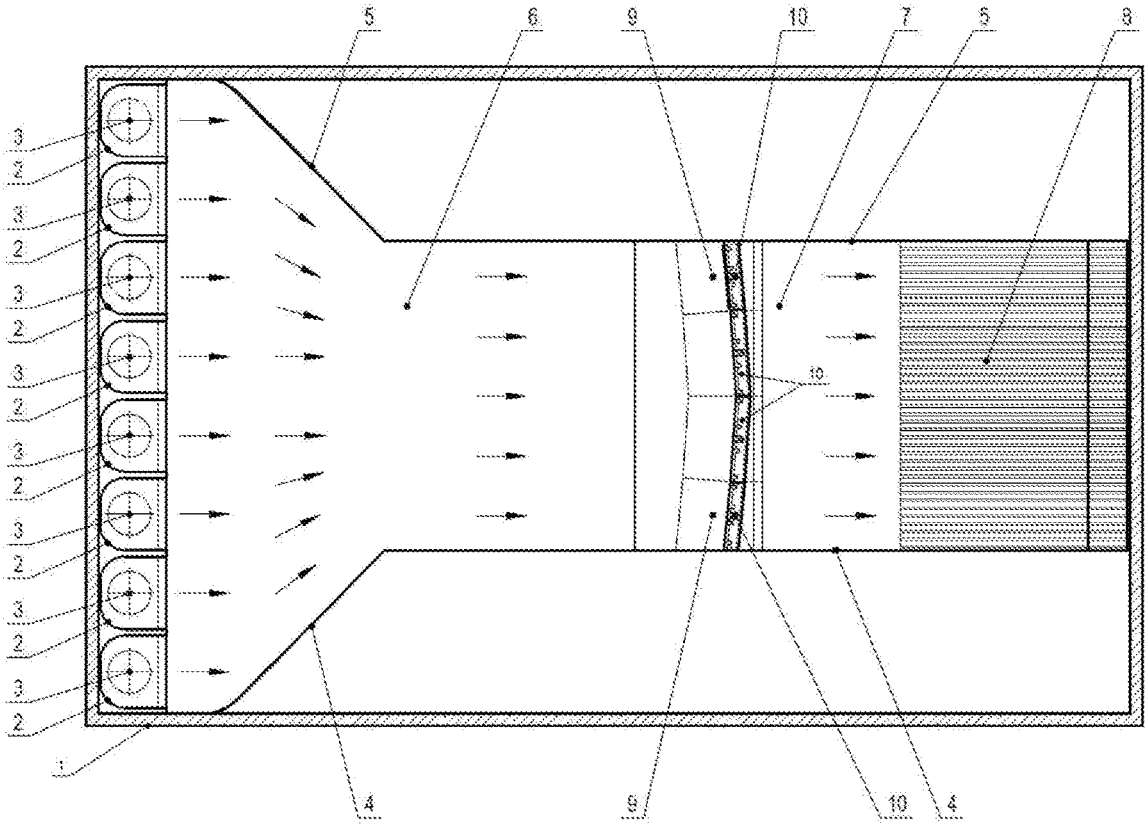
FIG. 7 shows a top view of the surfing facility according to the present invention showing a tapering inclined surface and without inspection platforms.
Figure 8A:
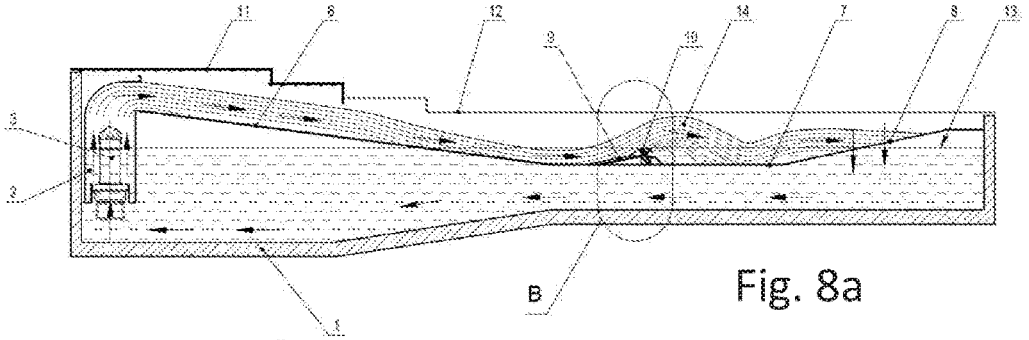
FIG. 8*a* shows a cross sectional view of the surfing facility according to the present invention including a tapering inclined surface and a wave crest section.
Figure 8B:
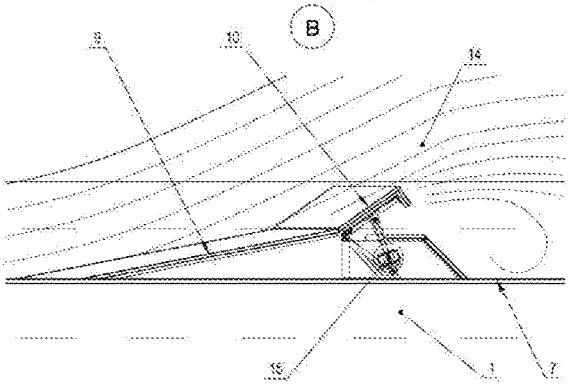
FIG. 8*b* shows an enlarged view of the wave crest section around section B of FIG. 8*a;*
Figure 9A:
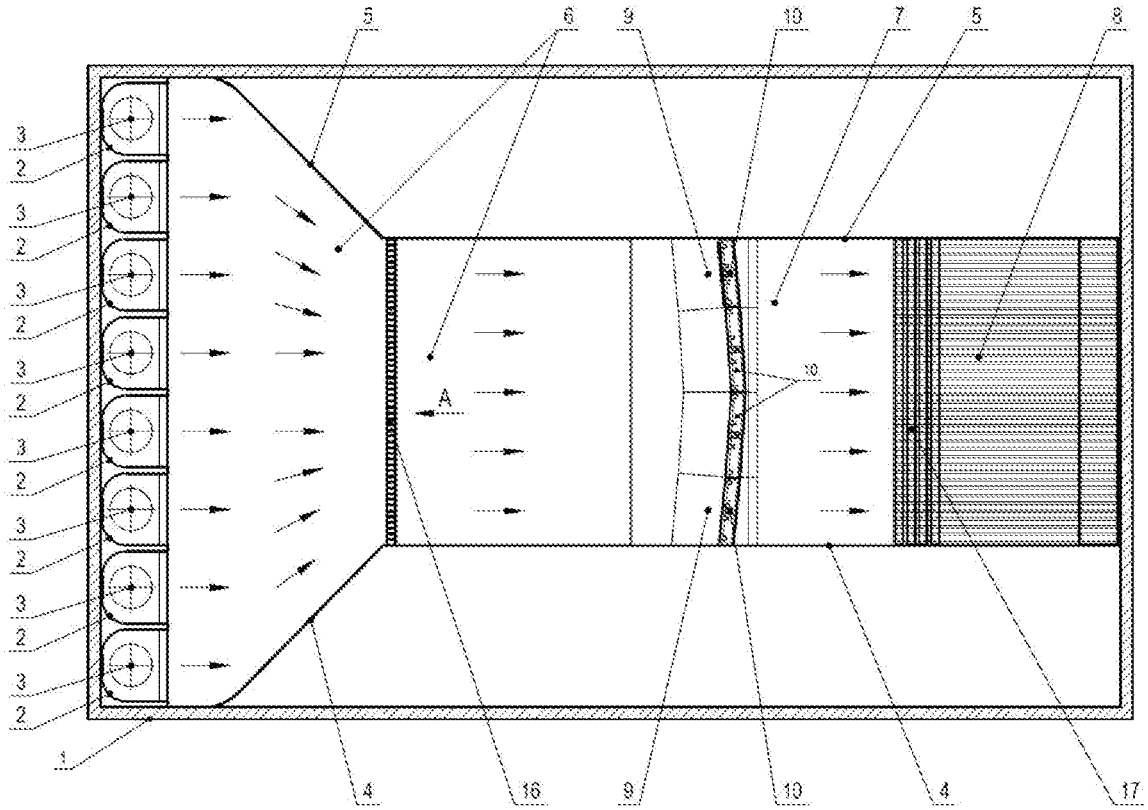
FIG. 9*a* shows a top view of the surface facility of FIG. 1 with a flow stabilizer and without inspection platforms.
Figure 9B:
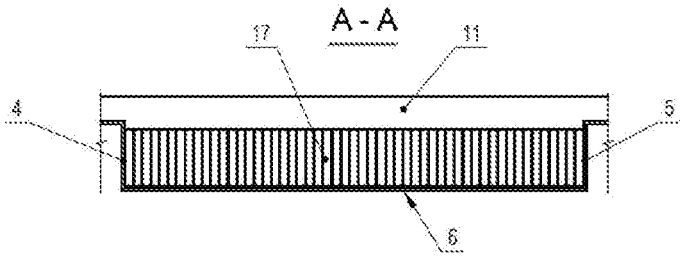
FIG. 9*b* shows a side view of a flow stabilizer of FIG. 9*a;*
Figure 10A:
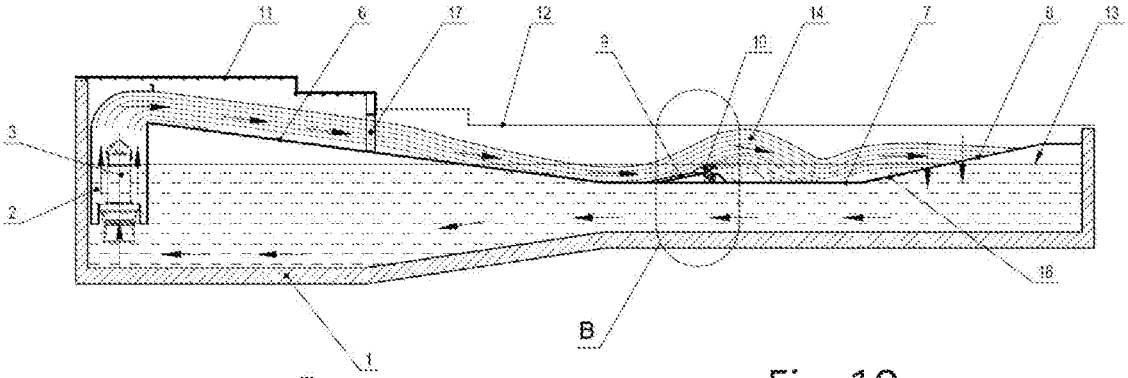
FIG. 10*a* shows a cross sectional view of the surfing facility according to the present invention including a tapering inclined surface and a flow stabilizer.
Figure 10B:
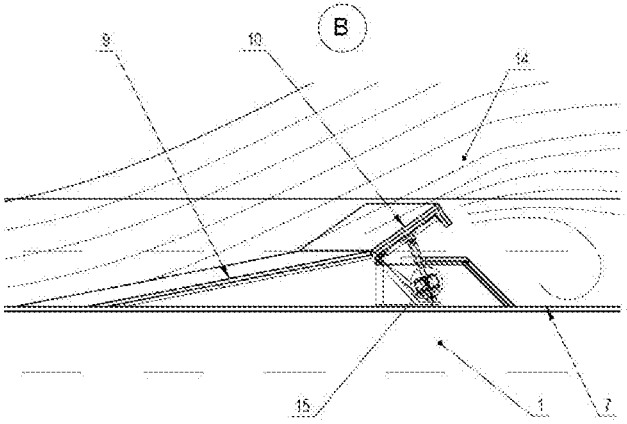
FIG. 10*b* shows an enlarged view of the wave crest section around section B of FIG. 10.

Inclined section 6 may be configured tapering from upper to lower edge to a specified level from which the flow width to the inclined section lower edge coming into abutment with channel bottom 7 remains constant (see the embodiments in FIG. 6, FIG. 7, and FIG. 8), which makes the design simpler while retaining the capability to control the water flow rate and to stabilize the flow. The span where the flow width remains constant may house a partition with sections used to stabilize the flow (see the embodiments in FIG. 6, FIG. 9, and FIG. 10).

Threshold 9 serving to generate waves may be configured as a fixture repositionable relative to the flooring and in the form of crest 15 hoist, which also makes it possible to control the water flow rate and to stabilize the flow.

The invention claimed is:

1. An artificial wave generation surfing facility comprising:

a water tank having an upper portion, a lower portion, a first end, and a second end;

a central platform located at the upper portion on the first end of the water tank;

a working surface located underneath of the central platform at the upper portion of the water tank, the working surface having an inclined section located at the first end of the water tank, the inclined section of the working surface having an upper edge and a lower edge;

a drainage grille located at the second end of the water tank;

a submersible pump located at the first end of the water tank, the submersible pump having an outlet;

a water moving device connected to the outlet of the submersible pump, the water moving device having an outlet with a direct exit channel to the upper edge of the inclined section of the working surface, the water moving device is partitioned into sections;

a wave generation threshold located on a flooring positioned at the lower edge of the inclined section of the working surface, wherein the wave generation threshold is located at the flooring between the lower edge of the inclined section and the drainage grille, wherein the wave generation threshold includes a wave forming crest and a crest hoist;

a plurality of partitions housed by the inclined section of the working surface, the plurality of partitions stabilized the flow;

wherein the inclined section is directly connected to the wave generation threshold and the direct exit channel of the water moving device; and wherein the inclined section is tapering from the upper edge to the lower edge of the water tank to a span level from which a flow width to the inclined section lower edge coming into abutment with a bottom channel remains constant.

2. An artificial wave generation surfing facility comprising:

a water tank having an upper portion, a lower portion, a first end, and a second end;

a central platform located at the upper portion on the first end of the water tank;

a working surface located underneath of the central platform at the upper portion of the water tank, the working surface having an inclined section located at the first end of the water tank, the inclined section of the working surface having an upper edge and a lower edge;

a drainage grille located at the second end of the water tank;

a submersible pump located at the first end of the water tank, the submersible pump having an outlet;

a water moving device connected to the outlet of the submersible pump, the water moving device having an outlet with a direct exit channel to the upper edge of the inclined section of the working surface, the water moving device is partitioned into sections;

a wave generation threshold located on a flooring positioned at the lower edge of the inclined section of the working surface, wherein the wave generation threshold is located at the flooring between the lower edge of the inclined section and the drainage grille, wherein the wave generation threshold includes a wave forming crest and a crest hoist;

a plurality of sections housed by the inclined section of the working surface, the plurality of partitions stabilized the flow;

wherein the inclined section is directly connected to the wave generation threshold and the direct exit channel of the water moving device; and wherein the inclined section is tapering from the upper edge to the lower edge of the water tank to a span level from which a flow width to the inclined section lower edge coming into abutment with a bottom channel remains constant;

wherein the span level houses a plurality of sections.

3. The surfing facility of claim 1, wherein the wave generation threshold is configured as a fixture repositionable relative to the flooring.

* * * * *